United States Patent [19]

Gelzheiser

[11] 4,148,004

[45] Apr. 3, 1979

[54] CIRCUIT BREAKER WITH CALIBRATING MEANS

[75] Inventor: Francis L. Gelzheiser, Fairfield, Conn.

[73] Assignee: Westinghouse Electric Corp., Pittsburgh, Pa.

[21] Appl. No.: 793,579

[22] Filed: May 4, 1977

[51] Int. Cl.[2] ..... H01H 71/16

[52] U.S. Cl. ..... 337/82; 337/84

[58] Field of Search ..... 335/18, 45; 337/75, 337/78, 82, 84; 361/42

[56] References Cited

U.S. PATENT DOCUMENTS

| | | | |
|---|---|---|---|
| 2,798,918 | 7/1957 | Gelzheiser | 337/84 |
| 3,211,861 | 10/1965 | Freese | 337/84 |
| 3,848,211 | 11/1974 | Russell | 337/82X |
| 3,943,477 | 3/1976 | Kidd et al. | 337/82 X |

FOREIGN PATENT DOCUMENTS

| | | | |
|---|---|---|---|
| 1028634 | 5/1966 | United Kingdom | 337/84 |

*Primary Examiner*—George Harris
*Attorney, Agent, or Firm*—L. P. Johns

[57] ABSTRACT

A circuit breaker characterized by an electrically insulating housing containing a circuit breaker structure comprising a pair of separable contacts and having associated therewith a bimetal member having one end fixedly mounted on an outturned flange of a support frame for the circuit breaker structure, and a rotatable calibrating plug operatively connected to the assembly of the flange and the bimetal for rotating the bimetal between varying angles of calibration.

4 Claims, 5 Drawing Figures

CIRCUIT BREAKER WITH CALIBRATING MEANS

BACKGROUND OF THE INVENTION

1. Field of the Invention

This invention relates to a circuit breaker and, more particularly, it pertains to a rotatable, externally accessible knob for calibrating the bimetal member of the circuit breaker without the necessity of disassembling the circuit breaker housing.

2. Description of the Prior Art

Certain types of circuit breakers comprise mechanisms that are preliminarily calibrated and then completely enclosed by housing parts that are riveted or otherwise fixedly secured together. During assembly subsequent to the preliminary calibration some breakers fall out of calibration and it has been necessary to remove the rivets or other securing means in order to recalibrate the mechanism after which the housing parts are reassembled. During these operations the expensive electronics portion of the circuit breaker is jeopardized and often results in substantial loss of this portion as well as loss of the housing due to cracking, chipping, distortion, and misalignment of housing parts. As a result the prior method of calibrating a circuit breaker of the type involved has been unsatisfactory.

SUMMARY OF THE INVENTION

It has been found in accordance with this invention that the foregoing problem may be overcome by providing a circuit breaker comprising an electrically insulating housing and including a box-like container and a cover therefor, a circuit breaker structure within the housing and comprising a pair of separable contacts operable between open and closed positions, a releasable member in an initial position and movable when released to a tripped position to effect automatic opening of the contacts and comprising an elongated current carrying bimetal for tripping the releasable member when a predetermined current overload effects deflection of said bimetal in one direction from a latched position, a support frame within the housing for supporting the circuit breaker structure, the support frame comprising an outturned flange, a portion of the bimetal being fixedly mounted on the flange in surface-to-surface abutment, a rotatable calibrating plug operatively connected to the assembly of the flange and the bimetal for rotating the bimetal between varying angles of calibration, the calibrating plug comprising a slot which straddles the assembly of the flange and the bimetal, the cover comprising aperture means through which the calibrating plug extends, the external end of the calibrating plug comprising tool-receiving means for rotating the plug, the plug comprising a radial flange biased against the inner surface of the cover, and the radial flange comprising a peripheral lip in snug contact with the inner surface.

The advantage of the circuit breaker of this invention is that it comprises a relatively inexpensive part which enables calibration and final testing after complete assembly of the circuit breaker. In addition, the circuit breaker of this invention eliminates all changes, stresses, distortion, and the like brought about through separate calibration, assembly after calibration and riveting of the assembly as in circuit breakers of prior construction. Finally, the relatively expensive electronic portion of the circuit breaker is not jeopardized by the calibration procedure.

DESCRIPTION OF THE PREFERRED EMBODIMENTS

Figure 1:
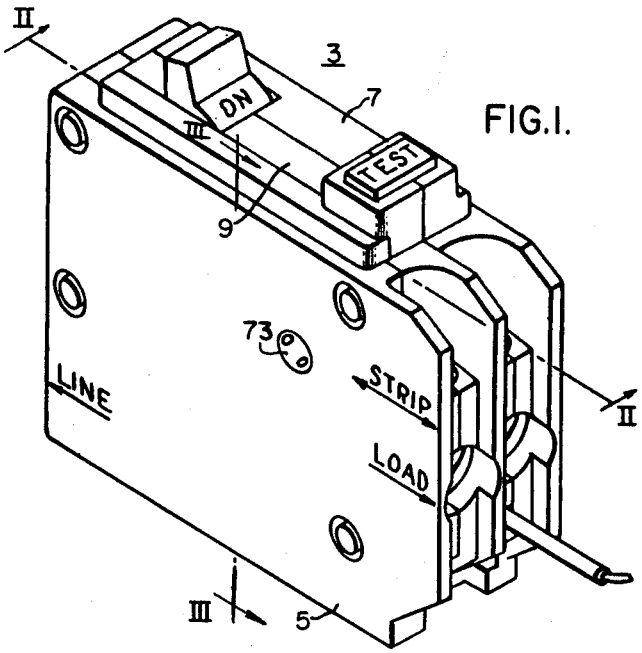
FIG. 1 is a perspective view of a ground fault circuit breaker.
Figure 2:
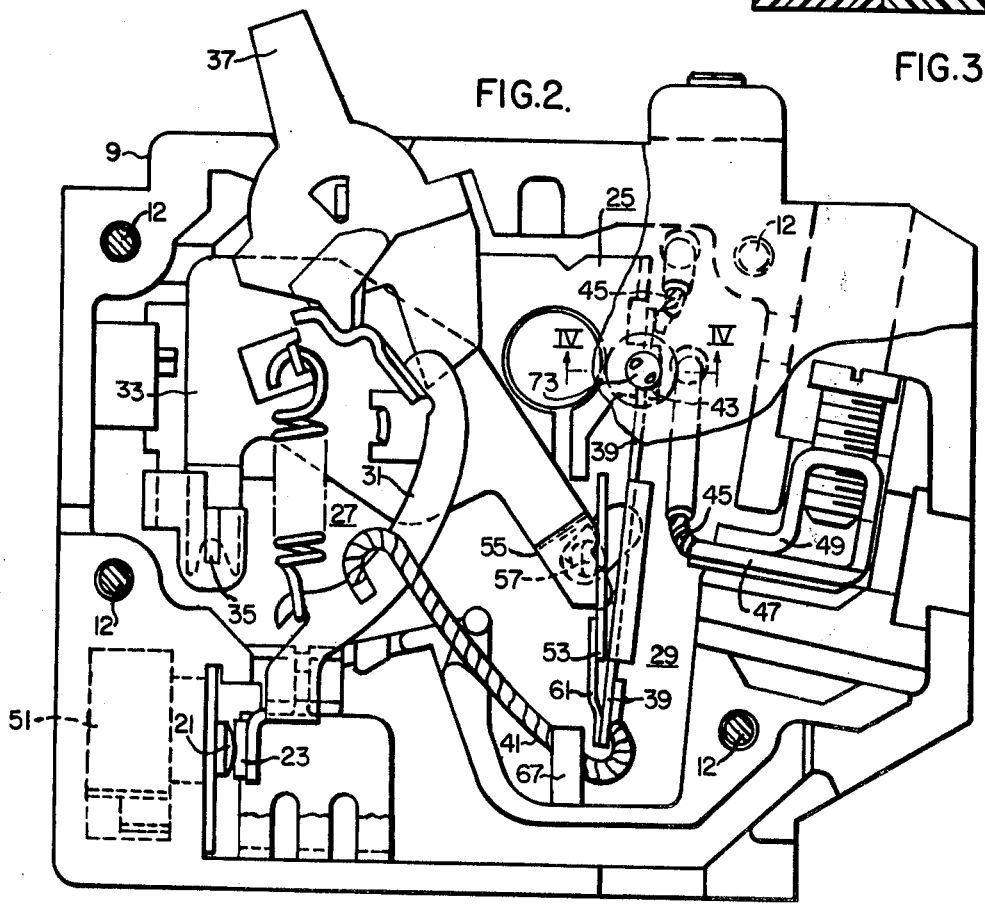
FIG. 2 is a vertical sectional view, taken on the line II—II of FIG. 1, and showing the circuit breaker side of the invention in the closed position.

In FIG. 1 a ground fault circuit breaker structure is generally indicated at 3 and it comprises a housing 5 which is composed of electrically insulating material such as a thermosetting resin. The housing 5 includes a pair of box-like containers or tray portions 7 and 9 and a side cover 11, which are secured in place by suitable means, such as rivets 12 (FIG. 2), in a conventional manner.

Inasmuch as a detailed description of both the ground fault detector portion and the circuit breaker portion is set forth in U.S. Pat. Nos. 3,858,130, and 3,999,103, the description of those portions is limited to the parts that are essential to the operation of the invention disclosed herein.

Figure 3:
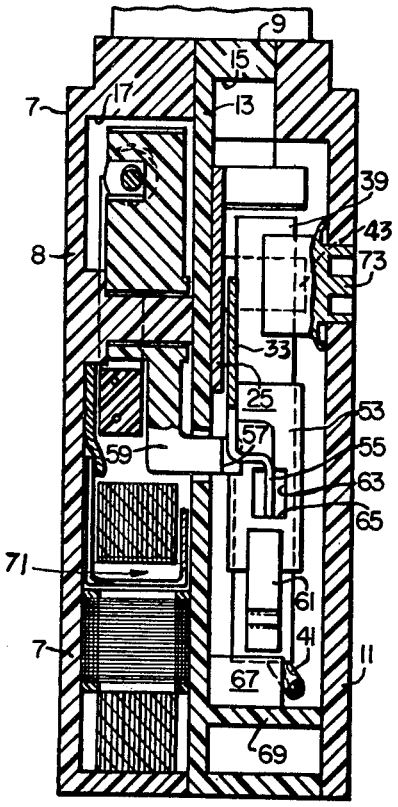
FIG. 3 is a sectional view taken along the line III—III of FIG. 1.

As shown in FIG. 3 the tray portion 7 comprises a back wall 8 and the tray portion 9 comprises a back wall 13 that serves as a single partition wall between compartments 15 and 17 formed between the back walls 8 and 13 and the side cover 11. A circuit breaker mechanism is disposed within the compartment 15 and a ground fault circuit interrupter is disposed within the compartment 17.

Briefly, the circuit breaker structure comprises a stationary contact 21, a movable contact 23, a supporting metal frame 25, an operating mechanism 27, and a trip device 29. Among other things, the operating mechanism 27 comprises a contact arm 31 and a releasable member 33 which is pivotally supported at one end thereof on a pivot 35. When the circuit breaker is opened manually, a handle 37 is rotated from the "On" to the "Off" position, whereby the contact arm 31 moves the movable contact 23 away from the stationary contact 21 in a conventional manner.

The contact arm 31 is electrically connected to the lower end of an elongated bimetal element or bimetal 39 by a flexible conductor 41. The bimetal 39 is part of the trip device 29 and is secured at its upper end to a flange 43 of the frame 25.

A flexible conductor 45 connects the upper end of the bimetal 39 with a terminal strap 47 having a terminal connector 49. Thus, the closed circuit through the circuit breaker extends from a terminal 51 through the stationary contact 21, the movable contact 23, the contact arm 31, the flexible conductor 41, the bimetal 39, the flexible conductor 45, and the terminal strap 47 to the terminal connector 49. The flexible conductor 45 extends from the bimetal 39 through the back wall 13, through a ground fault sensing toroid in the compartment 17 and back through the wall 13 as disclosed in U.S. Pat. No. 3,999,103.

The trip device 29 comprises the bimetal 39, an elongated rigid magnetic armature or latch member 53, an end portion 55 of the releasable member 33, and a projection 57 of a lever 59 (FIG. 3). The latch member 53 was mounted on the upper end of a flexible metal strip 61, the lower end of which is secured to the lower end of the bimetal 39 in a suitable manner such as a spot weld.

As shown in FIG. 3 the latch member 53 has an opening 63 which includes a latch surface 65 at the base of the opening in the reset position of the circuit breaker as shown in the drawings. The end portion 55 of the releasable member 33 is latched in the opening 63 of the latch member 53, and more particularly is lodged upon the latch surface 65. Upon the occurrence of a sustained overload current above a first predetermined value the bimetal 39 which is heated by the current flowing therethrough, deflects from the position shown in FIG. 2 to a thermally-tripped position to the right of that shown in FIG. 2, whereupon the end portion 55 drops from its position on the latch surface 65. A bimetal stop means or projection 67 is provided to prevent the bimetal 39 from moving to the left of the latched position (FIG. 2), such as when the bimetal is exposed to severely cold ambient temperature conditions such as of the order of −35° C. The projection 67 is preferably a molded part of the tray portion 9 and extends outwardly from the back wall 13 as well as a bottom wall 69. However, the projection 67 would function satisfactorily if it were part of the cover 11.

In the position shown in FIG. 3 the upper end of the projection 67 extends slightly above the lower end of the bimetal 39 so as to prevent the bimetal from moving to the left in response to severely cold ambient temperatures. The projection 67 however may be located at another position along the length of the bimetal so long as it is suitably disposed to prevent the bimetal from moving unduly to the left beyond the latched position of FIG. 2. In effect a thermal restriction is produced within the compartment 15 so that upon a limited movement of the bimetal 39 when subjected to cold temperature, a motion takes place where the lower free end of the bimetal engages the projection 67 to restrict further deflection. As a result a binding effect between the spring loaded end portion 55 of the releasable member 33 and the latch surface 65 is avoided and the bimetal 39 is free to operate in a conventional manner.

Where a ground fault occurs and is detected in a ground fault detector 71 in the compartment 17, as set forth in the above-mentioned U.S. Pat. No. 3,999,103, the lever 59 is actuated to cause the projection 57 at the lower end thereof to move the latch member 53 to the right and thereby disengage the end portion 55 of the releasable member 33 from the latch surface 65. In ground fault circuit breakers where the unit has been subjected to a temperature of as low as −35° C. for a period of hours or days the circuit breaker must nevertheless be able to trip free in 0.25 milliseconds or less when subjected to 260 milliampere ground fault circuits which are unable to heat the bimetals to cause deflection.

A ground fault circuit breaker mechanism is activated on a ground fault by the use of a toroid sensor, electronic amplifier and power device, and a solenoid, as disclosed in the above indicated patent application. The solenoid is the action member which depresses the spring latch to effect disconnection. If the bimetal 39 is deflected in the direction to cause latch interference, the solenoid is unable to depress the latch sufficiently to overcome the excessive deflection caused by cold temperature on the bimetal and thereby causing an inoperative device.

Figure 4:
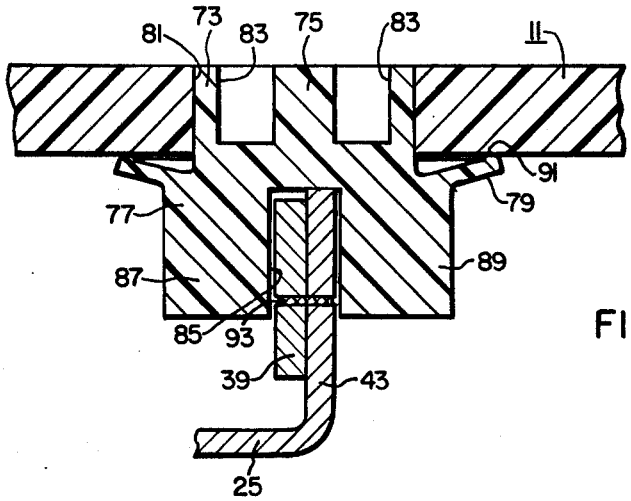
FIG. 4 is a vertical sectional view taken on the line IV—IV of FIG. 2.

In accordance with this invention the circuit breaker 3 comprises a calibrating plug or member 73. As shown in FIG. 4, the calibrating plug 73 comprises a knob 75, a bifurcated portion 77, and a radial flange 79. The knob 75 extends through an opening 81 in the cover 11 and is preferably flush with the outer wall of the cover. The knob also comprises aperture means, such as a pair of spaced holes 83, which are adapted to receive a driver tool (not shown) for rotating the plug when calibrating the circuit breaker. The bifurcated portion 77 includes a slot 85 forming spaced plug portions 87, 89. As shown in FIG. 3 the assembly of the bimetal 39 and the flange 43 extend into the slot 85 and between the portions 87, 89 so that upon rotation of the plug the bimetal and flange are turned to the desired calibrated position. The calibrating plug 73, being preferably comprised of an electrically insulating material, is installed on the bimetal and frame just before the cover 11 is attached to the circuit breaker 3. The bifurcated portions 87, 89 straddle the bimetal 39 and flange 43 with the knob 75 extending through the opening 81 where the aperture means 83 are externally accessible for a driver tool. Though the knob 75 is disclosed as being turned by a driver tool, the knob may be provided with an external portion adapted for manual rotation.

As shown in FIG. 4 the radial flange 79 fits snugly against the inside surface of the cover 11. In the disassembled condition of the plug 73 the flange 79 extends upwardly at a slight angle to the vertical rotating axis of the plug. Upon assembly the flange fits tightly against the inside surface of the cover to provide a seal around the opening 81. In addition the flange 79 comprises a peripheral bead or lip 91 which bears against the cover surface to eliminate any air gap that may otherwise exist and thereby avoid electrical creepage.

After final assembly with the cover 11 in place, a circuit breaker is calibrated. For that purpose the circuit breaker is placed in a calibrating fixture, a torque driver is attached to the aperture means 83 and a prescribed current is applied. At a designated time the torque driver rotates the calibrating plug 73 in a counterclockwise direction which turns the assembly of the flange 43 and bimetal 39 until the breaker trips. In this manner the bimetal 39 is turned through an arc of from 1 to 4 degrees. The circuit breaker is then removed from the calibrating fixture and allowed to cool to room temperature. At room temperature the breaker 3 is retested by standard procedure and if within limits, is ready for shipment. However, if the breaker tests low or high, a hand operation with a similar torque driver tool is used to change the calibration in a low or high mode.

Figure 5:
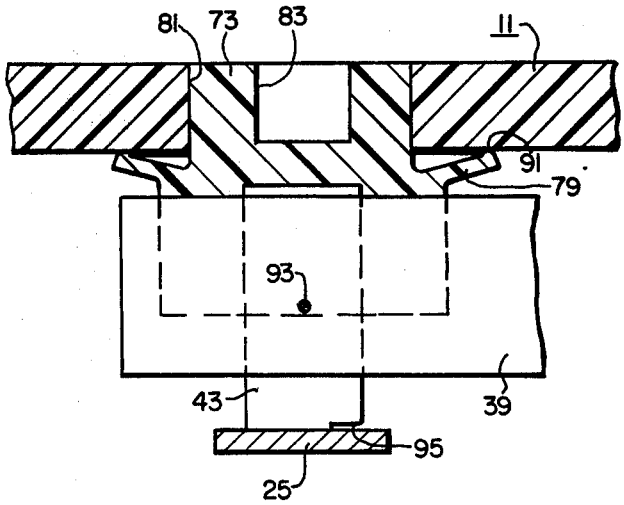
FIG. 5 is a vertical sectional view of another embodiment of the calibrating plug.

Another embodiment of the invention is shown in FIG. 5 in which similar numbers refer to similar parts. As indicated above the bimetal 39 is fixedly mounted on the flange 43 in a suitable manner such as by a spot weld 93. In the event that the flange 43 is difficult to turn the flange may have either reduced thickness at the corner where it turns up from the metal frame 25, or it may have a notch 95 to reduce the effective width of the flange and thereby enable easier calibration.

As an alternative to mounting the calibration knob 73 over the assembly of the flange 43 and bimetal 39, the knob may be mounted entirely over the bimetal. That may be accomplished by locating the knob 73 a sufficient distance to the right (FIG. 5) of the flange 43 so that the slot 85 straddles only the bimetal 39. Thereafter, calibration of the circuit breaker 3 is accomplished merely by rotating the bimetal to the desired position.

Accordingly, the advantage of the device of this invention is that a relatively inexpensive part is provided to enable calibration of the circuit breaker without disassembly thereof. This eliminates all the changes, stresses, distortions and the like which are brought about through separate calibration, assembly after calibration, and riveting after calibration. Finally, it eliminates all jeopardy to the electronic packaging.

What is claimed is:

1. A circuit breaker comprising an electrically insulating housing and including a box-like container and a cover therefor, a circuit breaker structure within the housing and comprising a pair of separable contacts operable between open and closed portions, a releasable member in an initial position and movable when released to a tripped position to effect automatic opening of the contacts and comprising an elongated current carrying bimetal for tripping the releasable member when a predetermined current overload effects deflection of said bimetal in one direction from a latched position, a support frame within the housing for supporting the circuit breaker structure, the support frame comprising an outturned flange, a portion of the bimetal being fixedly mounted on the flange in surface-to-surface abutment, a rotatable calibrating plug operatively connected to the bimetal for rotating the bimetal between varying calibration modes, said plug comprising a bifurcated portion including spaced plug portions having a slot therebetween and through which the bimetal extends, and the plug portions extending in zones parallel to the axis of rotation of the plug to cause the slot and the bimetal to rotate in unison through similar angles.

2. The circuit breaker of claim 1 in which the calibrating plug comprises tool-receiving means for rotating the plug.

3. The circuit breaker of claim 2 in which the plug comprises a radial flange biased against the inner surface of the cover.

4. The circuit breaker of claim 3 in which the radial flange comprises a peripheral lip in snug contact with the inner surface.

* * * * *